United States Patent [19]

Flam et al.

[11] 4,045,835

[45] Sept. 6, 1977

[54] POWER DEFLATOR MECHANISM FOR SCUBA BUOYANCY VESTS

[75] Inventors: Fred Flam, Los Angeles; Dennis L. Hart, Hacienda Heights, both of Calif.

[73] Assignee: Under Sea Industries, Inc., Compton, Calif.

[21] Appl. No.: 718,908

[22] Filed: Aug. 30, 1976

[51] Int. Cl.[2] ..... B63C 9/24

[52] U.S. Cl. ..... 9/313; 9/342; 61/70; 128/142.2

[58] Field of Search ..... 9/313, 311, 329, 324, 9/336-339, 340-342; 114/16 E; 61/69 R, 70, 71; 128/142, 142.2, 145.8, 145.6

[56] References Cited

U.S. PATENT DOCUMENTS

| | | | |
|---|---|---|---|
| 3,487,647 | 1/1970 | Brecht, Jr. | 114/16 E |
| 3,527,555 | 9/1970 | Schreiber | 128/145.8 |
| 3,621,842 | 11/1971 | Manley | 128/145.6 |
| 3,727,250 | 4/1973 | Koehn et al. | 9/313 |
| 3,820,348 | 6/1974 | Fast | 114/16 E |
| 3,898,705 | 8/1975 | Schuler | 9/313 |

*Primary Examiner*—Trygve M. Blix
*Assistant Examiner*—Stuart M. Goldstein
*Attorney, Agent, or Firm*—Flam & Flam

[57] ABSTRACT

A power deflator for a buoyancy vest includes a Venturi tube attached to the vest fitting. A mouthpiece control unit has an actuator movable in a path. Initial movement opens a conduit for slow deflection powered by ambient pressure. Continued movement of the actuator sends pressurized air through the Venturi tube for faster deflation of the vest.

9 Claims, 3 Drawing Figures

3
3
10
14
16
18
20
22
24
26
27
28
30
32
34
36
38
40
42
44
46
48
50
52
54
56
58
60
62
64
66
68
70
72
74
76
78
79
80
81
82
83
84
86

POWER DEFLATOR MECHANISM FOR SCUBA BUOYANCY VESTS

FIELD OF THE INVENTION

This invention relates to scuba diving, and more particularly to buoyancy vests of the type shown and described in Koehn et al U.S. Pat. No. 3,727,250 and to the methods of inflating and deflating them.

BACKGROUND OF THE INVENTION

Buoyancy vests have become increasingly popular as a convenient means for a scuba diver to control his rate of ascent and descent. When such buoyancy vests were first used, the lung power of the diver was used to inflate the vest through a non-return valve while a manipulation of the non-return valve was used to open the valve to deflate the vest. For that purpose, the vest was provided with a large inflation tube with a combined mouthpiece and check valve at the end. The Koehn et al patent illustrates a composite mouthpiece readily attached to the distal end of the inflation hose in place of the conventional mouthpiece. The composite device includes a push valve and coupling to the high pressure source of breathable gases for powered inflation. Deflation by means of mere valve opening is slow and incomplete.

It has been proposed to utilize a Venturi device for aspirating the vest air. This device utilizes a complicated operating mechanism wherein both the exhaust valve and the inlet valve are simultaneously operated to achieve power deflation. This is cumbersome and somewhat unnatural. Other disadvantages exist: the control unit mounted at the end of the inflation tube is bulky and unmanageable; the jet thrust of escaping air adds to the instability.

The primary object of the present invention is to provide an improved, easy to operate and stable mechanism for power inflation and deflation of the buoyancy vest.

SUMMARY OF INVENTION

In order to accomplish the foregoing objectives, the Venturi tube is attached to the vest fitting rather than forming a part of the mouthpiece control unit. The button for moving the check valve stem to open position for unpowered exhaust sends high pressure air or gas to the Venturi device only at the end of the path of button movement.

BRIEF DESCRIPTION OF DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF PREFERRED EMBODIMENT

The following detailed description is of the best presently contemplated mode of carrying out the invention.

This description is not to be taken in a limiting sense, but is made merely for purposes of illustrating the general principles of the invention since the scope of the invention is best defined by the appended claims.

Figure 1:
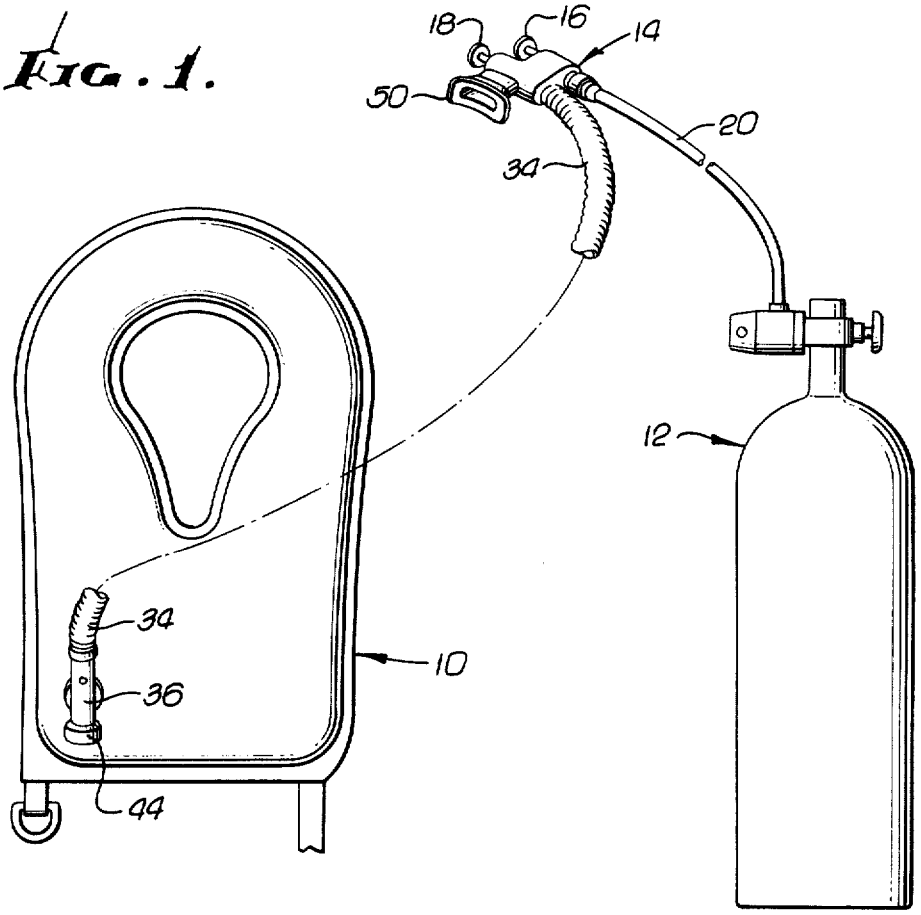
FIG. 1 is a pictorial view of a buoyancy vest incorporating the present invention.

In FIG. 1, there is illustrated a buoyancy vest 10 designed to contain a variable volume of air in order more or less to counterbalance by buoyancy, the combined weight of the diver and his equipment. The rate of ascent and descent are thereby determined.

Figure 2:
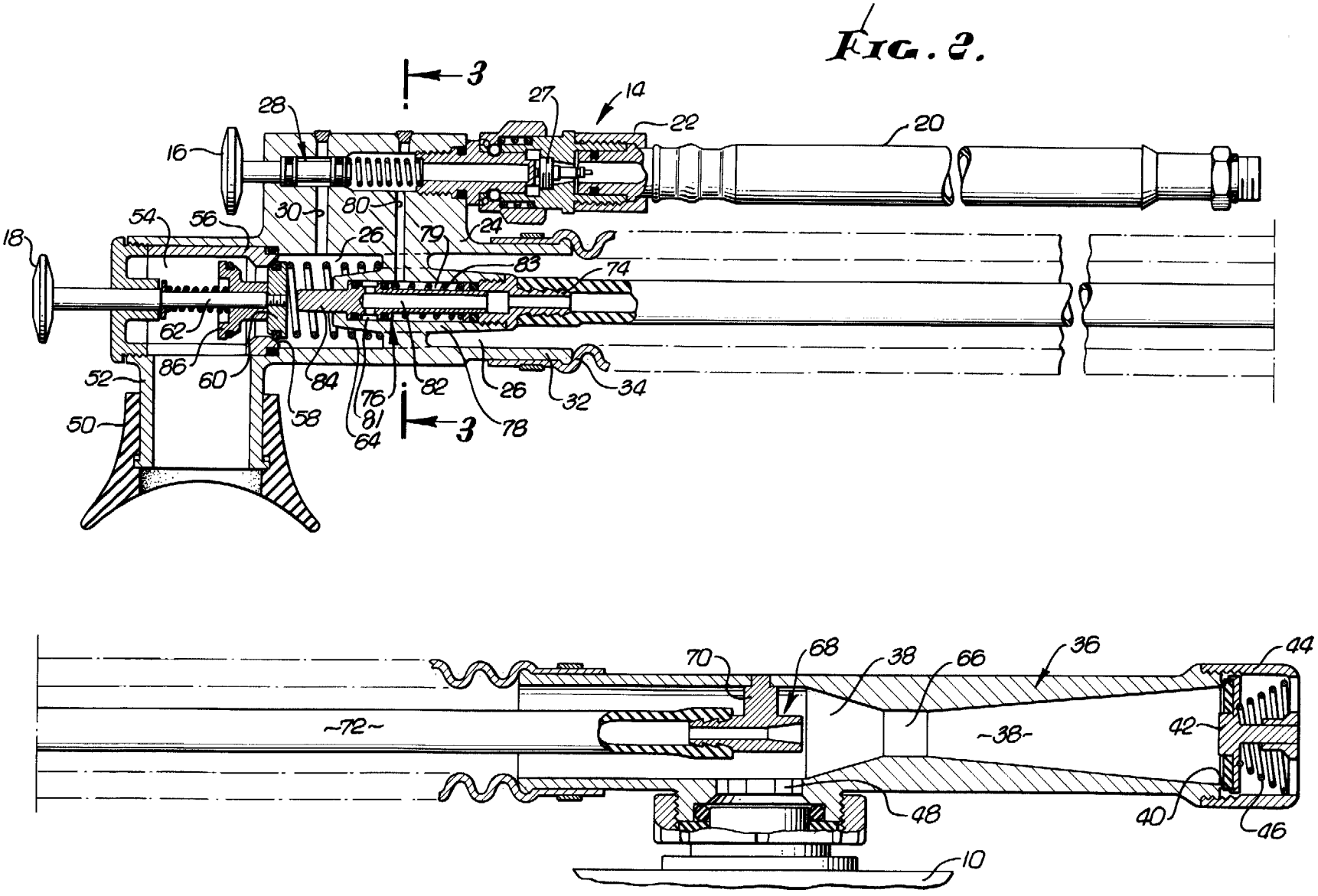
FIG. 2 is an axial sectional view both of the mouthpiece control unit and the vest aspirating unit, the concentric hoses joining the units being broken away.

Pressurized air from the supply tank 12 is used both to inflate and deflate the vest. A mouthpiece control unit 14 has two side-by-side digitally engageable actuating buttons 16 and 18 to inflate and deflate respectively. A high pressure hose 20 from the tank 12 connects with an inlet fitting 22 (FIG. 2) on the body 24 of the mouthpiece unit. The fitting 22 communicates with a large diameter supply passage 26 via a check valve 27 and normally closed spool valve 28 operated by the button 16. An outlet passage 30 from the valve 28 intercepts the supply passage 26 at a suitable place. The supply passage is surrounded at its outer end by a tubular part 32 for attachment of a hose 34 that not only conducts air to the vest, but also serves to mount the control unit 14.

The other end of the hose 34 is attached at one end of an elongated vest fitting 36. The fitting 36 has a through passage 38 that terminates in a port 40 that opens to the ambient. The port 40, however, is normally closed by a valve closure 42 piloted in a cap 44 which is attached, as by screw threads, to the end of the fitting 36. A coiled spring 46 captured by the cap 44 urges the closure to closed position.

The fitting 36 has a lateral passage 48 intermediate its length that connects to a companion vest fitting. The lateral passage 48 establishes uninterrupted communication between the interior of the vest 10, the passage 38, supply hose 34 and the control unit supply passage 26. The valve 42 serves as a blow-off valve to limit the vest pressure.

Air from the vest 10 and associated passages can be removed via a mouthpiece 50 on the control unit. The mouthpiece communicates with the supply passage 26 at the end opposite the hose 34. The mouthpiece is attached to a lateral conduit 52 that intercepts a valve chamber 54 located adjacent the supply passage 26. A sleeve-like seat member 56 is held in the chamber 54. The valve chamber 54 and the supply passage 26 communicate via a seat 58 formed at the inner end of the member 54. A valve closure 60 engages the inside part of the seat 58 in order normally to interrupt communication. For this purpose, the closure 60 is attached to the inner end of a stem 62 biased to close by a spring 64. The button 18 attaches to the outer end of the stem 62 for moving the valve closure 60 to open position. In open position, air from the vest 10, hose 34 and supply passage 26 exits via the mouthpiece. By aid of the mouthpiece, the vest air can be used as an emergency source for breathing.

By depressing the stem 62 all the way, high pressure air is sent to the vest fitting 36 for power deflation by an aspirating effect. Aspiration is accomplished by a Venturi configuration of the passage 38. Thus the passage has a maximum restriction 66 located between the vest lateral and the outlet port 40. For maximum efficiency, the passage 38 has a suitable tapered configuration on opposite sides of the restriction 66. Aspiration of the vest is accomplished by shooting a stream of high pressure air through the restriction 66 and past the blowoff valve 42. For this purpose, a Venturi jet 68 is supported in the passage 38 by a suitable supporting post 70. The jet 68 is supplied with high pressure air via a small diameter Venturi hose 72 that extends inside the supply hose 34.

Figure 3:
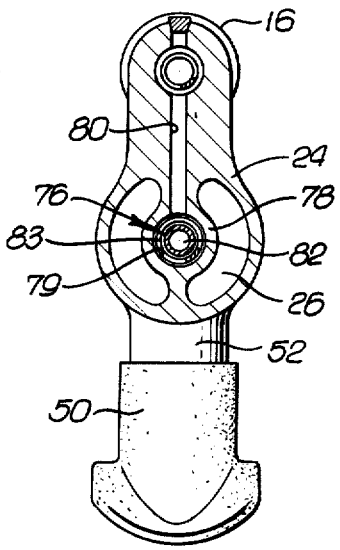
FIG. 3 is a sectional view taken along a plane corresponding to lines 3—3 of FIG. 2.

The opposite end of the supply hose connects to a fitting 74 of a high pressure valve 76. The valve 76 is mounted on a hub 78 supported by a web (FIG. 3) in supply passage 26. The valve includes a central chamber 79 continuously communicating with the high pressure supply fitting 14 by the aid of a passage 80 that extends through the web and the wall 78. A spool closure 82 is movable against the force of a bias spring 83 to place high pressure air in communication with the Venturi hose 72.

In order to move the closure 82, it is provided with an actuating rod 84 at the end opposite the hose fitting 74 positioned to be in the path of movement of the mouthpiece closure 60. Thus, after the supply passage 26 is opened to the mouthpiece, the valve 76 is opened to send a jet of air through the Ventrui orifice 66 whereby a power assisted deflation by aspiration is accomplished. The path for the power assist air can be traced from hose 20, check valve 27, passage 80 to the chamber 79, now aligned annular groove 81 of the valve 76, then through the spool closure 82 and fitting 74 to the Venturi hose 72. The blowoff valve 42 opens immediately in response to the influence of the blast of air and closes just as soon as it shuts off. An undesirably large volume of water is prevented from being sucked into the supply passage 26 from the mouthpiece 50 by the aid of a closure 86 carried on the actuating stem 62. Power deflation is achieved as a part of a natural movement of the deflation button 18. Simply by using more or less force, the diver can determine either free deflation or power deflation. The aspiration device is so scaled that deflation is accomplished at a rate fast enough to achieve the job quickly, but slow enough to prevent cataclysmic downward surge of the diver. If too much air is purged from the vest 10, the diver simply moves his thumb to the adjacent inflation button 16. Since the aspirating device is attached to the vest end of the inflation hose 34, the bulk of the control unit is minimized for easy handling. The exhaust bubbles of air always form at a known position on the body of the diver so that special attention to the bubble flow is unnecessary.

Intending to claim all novel, useful and unobvious features shown or described, we make the following claims:

1. In a buoyancy control apparatus for a scuba diver:
a. a buoyancy vest having an inflatable and deflatable chamber;
b. a control unit having a supply passage in communication with said vest chamber and having an inlet passage cooperable with a source of high pressure gas, as from the source of breathable gases used by the diver;
c. said control unit including a normally closed inflation valve for conducting high pressure gas to said supply passage, said valve including a digitally engageable actuator;
d. means forming an aspirating passage in continuous communication with said vest chamber and having an inlet side and an outlet side on opposite sides of a restriction;
e. means forming a jet at the inlet side of said aspirating passage;
f. a normally closed valve at the outlet side of said aspirating passage;
g. said control unit including a normally closed deflation valve for conducting air from said supply passage to the ambient, said deflation valve including another digitally engageable actuator;
h. aspirating valve means operable only upon extended movement of said deflation valve actuator for supplying said jet with a stream of high pressure air.

2. The combination as set forth in claim 1 together with a vest fitting attached to said vest and at which said aspirating passage is formed; an inflation tube attached to said vest fitting at one end and mounting said control unit at the other end; said control unit including a mouthpiece communicating with said supply passage via said deflation valve.

3. In a buoyancy control apparatus for scuba divers:
a. a buoyancy vest having an inflatable and deflatable chamber;
b. a vest fitting having a Venturi passage therethrough, said Venturi passage having an inlet end and an outlet end;
c. said vest fitting having means connecting said vest chamber to the inlet end of said Venturi passage;
d. a normally closed valve at the outlet end of said Venturi passage;
e. means forming a Venturi jet at the inlet end of said Venturi passage;
f. an oral inflation hose attached to the vest fitting at the inlet end of said Venturi passage;
g. a control unit mounted on the distal end of the inflation hose;
h. said control unit including a normally closed inflation valve for conducting high pressure gas to said inflation hose, said inflation valve including a digitally engageable actuator;
i. said control unit including a normally closed deflation valve having an exhaust passage for conducting air from said hose to the ambient, said deflation valve including a second digitally engageable actuator;
j. said control unit also including normally closed Venturi valve means operable only upon extended movement of said deflation valve actuator, said Venturi valve means having an outlet; and
k. Venturi hose means joining the outlet of said Venturi valve to said Venturi jet.

4. The combination as set forth in claim 3 in which said Venturi hose is of relatively small diameter extending through said inflation hose.

5. The combination as set forth in claim 3 together with supplemental valve means operative to close the exhaust passage as the Venturi valve means is operated.

6. The combination as set forth in claim 5 together with a mouthpiece forming the end of said exhaust passage.

7. In a buoyancy control apparatus for scuba divers:
a. a buoyancy vest having an inflatable and deflatable chamber;
b. a vest fitting having a Venturi passage therethrough, said Venturi passage having an inlet end and an outlet end;
c. said vest fitting having a lateral for connecting the vest chamber to said inlet end of said Venturi passage;
d. a normally closed valve at the outlet end of said Venturi passage;
e. means forming a Venturi jet at the inlet end of said Venturi passage;

f. an inflation hose of relatively large diameter attached to the vest fitting at the inlet end of said Venturi passage;

g. a high pressure Venturi hose inside the oral inflation hose and connected at one end to said Venturi jet;

h. a control unit mounted on the distal end of the inflation hose;

i. said control unit having a pair of adjacent digitally engageable actuators, each of said actuators having a valve control stem movable in a path, one of said actuators being an inflation actuator and the other of said actuators being a deflation actuator;

j. a normally closed inflation valve moved to open position upon movement of said deflation actuator, and conducting high pressure gas from a source to said inflation hose;

k. a normally closed deflation valve moved to open position upon movement of said deflation actuator, and conducting gas from said inflation hose to the ambient; and l. a normally closed Venturi valve moved to open position only upon extended movement of said deflation actuator, said Venturi valve having an outlet connected to the other end of said Venturi hose.

8. The combination as set forth in claim 7 together with a normally open cutoff valve movable to close communication between the ambient and said inflation hose as said Venturi valve is moved to open position to prevent an undesirably large volume of ambient water from being sucked into said inflation hose.

9. The combination as set forth in claim 8 in which a mouthpiece forms the terminal portion of the exhaust passage from said deflation valve.

* * * * *